US009689557B2

(12) United States Patent
Chen et al.

(10) Patent No.: US 9,689,557 B2
(45) Date of Patent: Jun. 27, 2017

(54) LIGHT-EMITTING DEVICE

(75) Inventors: Peng Chen, Shenzhen (CN); Hao Li, Shenzhen (CN); Tingming Liu, Shenzhen (CN); Shengmei Zheng, Shenzhen (CN)

(73) Assignee: OSRAM GmbH, Munich (DE)

( * ) Notice: Subject to any disclaimer, the term of this patent is extended or adjusted under 35 U.S.C. 154(b) by 33 days.

(21) Appl. No.: 14/131,624

(22) PCT Filed: Jun. 4, 2012

(86) PCT No.: PCT/EP2012/060528

§ 371 (c)(1),
(2), (4) Date: Jan. 8, 2014

(87) PCT Pub. No.: WO2013/007450

PCT Pub. Date: Jan. 17, 2013

(65) Prior Publication Data

US 2014/0140074 A1 May 22, 2014

(30) Foreign Application Priority Data

Jul. 8, 2011 (CN) ..... 2011 1 0191297
Feb. 17, 2012 (CN) ..... 2012 1 0038565

(51) Int. Cl.

| | |
|---|---|
| ***F21V 7/20*** | (2006.01) |
| ***F21V 29/00*** | (2015.01) |
| ***F21V 17/16*** | (2006.01) |
| ***F21V 3/04*** | (2006.01) |
| ***F21V 19/00*** | (2006.01) |

(Continued)

(52) U.S. Cl.

CPC ..... *F21V 17/16* (2013.01); *F21S 4/28* (2016.01); *F21V 3/0436* (2013.01); *F21V 17/164* (2013.01); *F21V 19/004* (2013.01); *F21V 29/70* (2015.01); *F21V 29/76* (2015.01); *F21V 19/0045* (2013.01); *F21V 29/75* (2015.01); *F21Y 2103/10* (2016.08); *F21Y 2115/10* (2016.08)

(58) Field of Classification Search

CPC ..... F21V 17/16; F21V 17/164; F21V 29/22; F21V 29/70; F21V 29/75; F21V 29/76; F21V 3/0436; F21V 19/004; F21V 19/0045; F21S 4/008; F21Y 2103/003; F21Y 2101/02

USPC ... 362/373, 217.1, 368, 362, 217.01–217.17, 362/218–225, 249.02, 311.02

See application file for complete search history.

(56) References Cited

U.S. PATENT DOCUMENTS 8,319,433 B2 * 11/2012 Lin ..... B60Q 3/025 315/291
2003/0048641 A1 3/2003 Alexanderson et al.

(Continued)

FOREIGN PATENT DOCUMENTS

WO WO 2009/014387 1/2009
WO WO 2011/043166 4/2011

*Primary Examiner* — Jason Moon Han
(74) *Attorney, Agent, or Firm* — Cozen O'Connor

(57) ABSTRACT

A light-emitting device having a cover (1), a heat sink (2) and a light-emitting assembly (3), wherein the heat sink (2) has at least one first locking part (a), the cover (1) has at least one second locking part (b) corresponding to the first locking part (a), the second locking part (b) engages with the first locking part (a) to form an enclosed cavity (5) for the light-emitting assembly (3), and the second locking part (b) has a pressing part (b1) pressing the light-emitting assembly (3) against the heat sink (2).

13 Claims, 6 Drawing Sheets

(51) Int. Cl.

| | |
|---|---|
| ***F21V 29/70*** | (2015.01) |
| ***F21V 29/76*** | (2015.01) |
| ***F21S 4/28*** | (2016.01) |
| *F21V 29/75* | (2015.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 2009/0219713 | A1* | 9/2009 | Siemiet et al. | 362/218 |
| 2011/0317406 | A1* | 12/2011 | Lin et al. | 362/217.1 |
| 2012/0212950 | A1* | 8/2012 | Wei | 362/218 |
| 2012/0236562 | A1* | 9/2012 | Tran | 362/249.02 |
| 2013/0003363 | A1* | 1/2013 | Lu et al. | 362/217.02 |

* cited by examiner

LIGHT-EMITTING DEVICE

RELATED APPLICATIONS

This application is a U.S. National Phase Application under 35 USC 371 of International Application PCT/EP2012/060528 filed Jun. 4, 2012.

This application claims the priority of Chinese application Nos. 201110191297.0 filed Jul. 8, 2011 and 201210038565.X filed Feb. 17, 2012, the entire content of both of which are hereby incorporated by reference.

FIELD OF THE INVENTION

The present invention relates to a light-emitting device.

BACKGROUND OF THE INVENTION

In the light-emitting devices widely used in offices, shops, homes, etc., a fastening member such as a screw or an adhesive such as glue is generally needed to fix a light-emitting assembly in a housing or on a heat sink, for example, a large number of screws are used to fix the light-emitting assembly on the heat sink to ensure a good thermal conduct path between the light-emitting assembly and the heat sink.

If the fastening member is used for fixing, the positional relationship between the fastening member and the light-emitting assembly is usually limited by the manufacturing requirements, for example, as there are strict requirements on the spacing between electrical components and metal screws, the use of a large number of screws on the board affects adversely the circuit layout, and causes extra difficulties on the manufacturing (the production efficiency is lowered) and product maintenance.

If only the adhesive such as glue is relied on instead of using the fastening member to fix, for example, adhering the light-emitting assembly to the heat sink using a thermal conduct adhesive, unsafe factors arise when the volume or weight of the light-emitting assembly is relatively large, e.g., in the tube-shaped light-emitting device which is relatively long, the use of glue might cause accidents and mistaken adhesion caused by thermal expansion might result in potential separation/bending.

SUMMARY OF THE INVENTION

One object of the present invention lies in providing a light-emitting device. In such light-emitting device, a light-emitting assembly is fixed tightly on a heat sink without using an additional fastening member or adhesive, thereby reducing the number of the used components and facilitating installation and maintenance.

This and other objects are attained by one aspect of the present invention directed to a light-emitting device that comprises: a cover, a heat sink and a light-emitting assembly, wherein the heat sink has at least one first locking part, the cover has at least one second locking part corresponding to the first locking part, the second locking part engages with the first locking part to form an enclosed cavity for the light-emitting assembly, and the second locking part has a pressing part pressing the light-emitting assembly against the heat sink. The pressing part is in contact with the light-emitting assembly under the effect of a force, and a point of force application is formed.

In one embodiment of the present invention, the manner of using the fastening member to assemble the light-emitting assembly and the heat sink together is discarded, while the light-emitting assembly and the heat sink are assembled to be the whole housing of the light-emitting device in an engaging manner via special configurations of the heat sink and the cover according to the geometric and mechanical principles, moreover, the light-emitting assembly is fixed on the heat sink in a pressing manner by means of the second locking parts of the cover. Therefore, various defects brought by the fixing with the fastening member and the adhesive are overcome and the number of the used components is advantageously reduced.

According to a preferred embodiment of the present invention, the heat sink has a mounting part for the light-emitting assembly and outer edges located at two sides of the mounting part, and respective first locking part is a locking slot between the mounting part and the outer edge. The two locking slots defined thereby can provide a sufficient assembling space for the combination of the light-emitting assembly with the cover while not hindering the installation of the light-emitting assembly.

According to a preferred embodiment of the present invention, the second locking part is formed at an edge of the cover jointed with the heat sink, and the second locking part is a bending locking segment that is elastically deformable and received in the locking slot. The second locking part can be lockingly inserted into the pre-configured first locking part of the heat sink, viz. the locking slot. Such locking engagement may allow the cover and the heat sink to be advantageously combined into one body to form a housing receiving the light-emitting assembly therein.

According to an improved embodiment of the present invention, the pressing part is a protruding elastic bending part of the second locking part. The pressing part for pressing the light-emitting assembly against the heat sink is one part of the second locking part, which means that the insertion of the second locking part into the corresponding first locking part not only maintains a mutual locking between the cover and the heat sink, but also can press the light-emitting assembly to make it tightly fixed on the heat sink by using its own elastic bending part without the aid of an additional element.

Preferably, a side surface of the mounting part defining the first locking part extends obliquely outward and forms a clamping convex point together with a mounting surface of the mounting part, and respective second locking part has one end thereof formed with a clamping part acting on the clamping convex point and applies clamping force with the other second locking part in opposite direction. In an installing state, ends of the deformed second locking parts are inserted into the first locking parts, viz. the locking slots, respectively, and clamped with each other against the clamping convex points of the mounting part, thereby points of force application are formed at the clamping convex points for contact with the second locking parts, respectively.

Preferably, respective outer edge has one end thereof formed with an inward-bending part, the cover has counter-connecting edges overlapping outer surfaces of the inward-bending parts, respectively, and respective second locking part extends from corresponding counter-connecting edge. Herein, the inward-bending parts and the counter-connecting edges can be used to ensure the airtightness and the integrity of the light-emitting device, and the counter-connecting edges also act as transition segments to connect the main body of the cover and the second locking parts.

Preferably, respective second locking part is formed with a supporting part between the pressing part and the clamping part to be against the inner surface of the inward-bending part. In an installing state, an upward-directed force perpendicular to the inner surface is obtained by the supporting part by virtue of support by the inner surface of the inward-bending part, whereby the above-mentioned pressing part is provided with an upward-directed component force for pressing against the light-emitting assembly.

According to one embodiment of the present invention, respective second locking part has a first recessed arc-shaped part adjacent to the pressing part. Preferably, the second locking part has a second recessed arc-shaped part adjacent to the supporting part. By forming such recessed arc-shaped parts, the deformation of the second locking parts is buffered to prevent the breakage and reserve an assembling space for the corresponding parts of the heat sink, for example, spaces for end corners of the heat sink are reserved.

According to another embodiment of the present invention, the heat sink has a mounting part for the light-emitting assembly and outer edges located at two sides of the mounting part, and the first locking part is an end of the outer edge extending to a center of the light-emitting device. In this solution, an end of respective outer edge of the heat sink is directly configured to the first locking part, which thereby can simplify the process of assembling the heat sink and the cover.

Preferably, the second locking parts are formed at edges of the cover jointed with the heat sink, respectively, and the second locking parts are elastically deformable and pressed against the first locking parts, respectively. With the elastic deformation of the second locking parts, the second locking parts of the cover can be allow to apply forces to between the first locking parts of the heat sink.

Preferably, a horizontal component of a clamping force applied by one first locking part to corresponding second locking part and a horizontal component of a clamping force applied by the other first locking part to corresponding second locking part are in opposite directions. As a result, forces applied by the cover on the heat sink, especially forces applied by the second locking parts on the first locking parts, can be assured to be in opposite directions in a horizontal direction. To put it simply, the second locking parts of the cover are fixedly clamped, between the first locking parts of the heat sink in the horizontal direction.

Preferably, respective first locking part has a first contact surface and a second contact surface capable of interacting with the corresponding second locking part, wherein an angle defined between the first contact surface and the second con-tact surface is less than 90°. Particularly preferably, the angle defined between the first contact surface and the second contact surface is 45°.

Preferably, respective second locking part comprises a third contact surface capable of overlapping the first contact surface in a vertical direction, a fourth contact surface against the second contact surface and a top surface against the light-emitting assembly in a vertical direction.

Preferably, a sum of vertical components of the clamping forces is equivalent to a pressure applied by the cover to the light-emitting assembly.

Preferably, the cover is made of an elastic material, particularly a transparent plastic. Particularly preferably, the heat sink is made of a thermal conduct metal, thereby ensuring that the cover with a light-transmissive function may be deformed relative to the heat sink. Thus, according to the present invention, the cover and the heat sink can be locked with each other via the deformation of the cover.

According to a preferred embodiment of the present invention, a thermal conduct pad is arranged between the heat sink and the light-emitting assembly, such that the heat generated by the light-emitting assembly can be transferred, as much as possible, to the heat sink so as to realize a good heat dissipation effect.

Preferably, the light-emitting assembly is a circuit board equipped with a light-emitting module. The light-emitting module may be an LED or other light-emitting members.

It shall be understood that both the above general description and the following detailed description are for illustrative and explanative purposes in order to provide further description of the claimed present invention.

BRIEF DESCRIPTION OF THE DRAWINGS

In the drawings the same part is represented by the same reference sign. In the drawings.

DETAILED DESCRIPTION OF THE DRAWINGS

Figure 1:
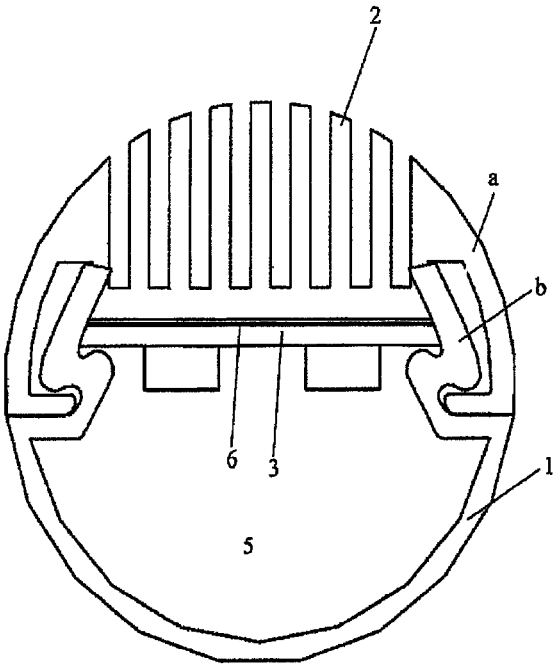
FIG. 1 is a cross-sectional view of a light-emitting device, before installation, of a first embodiment according to the present invention.

FIG. 1 is a cross-sectional view of a light-emitting device, before installation, of a first embodiment according to the present invention, wherein the light-emitting device comprises a cover 1, a heat sink 2 and a light-emitting assembly 3, wherein the light-emitting assembly 3 may be a circuit board equipped with a light-emitting member such as an LED. Preferably, the heat sink is made of a thermal conduct metal, and the cover is made of a transparent plastic, and a thermal conduct pad 6 is placed between the heat sink 2 and the light-emitting assembly 3. According to the present invention, the heat sink 2 is advantageously configured directly as a base of the light-emitting device and can form an integral housing with the cover. In the present embodiment, the cross sections of the heat sink and the cover each can be designed to be semicircular for constituting a housing with a circular cross section. In the present invention, the prior installing manner prior of fixing the light-emitting device and light-emitting assembly 3 therein by virtue of an additional member is discarded, while a "locking" concept is used to lock the heat sink 2 via the edges of the cover land meanwhile to fix the light-emitting assembly 3 in a pressing manner so as to achieve the purpose of self-combination and self-assembly.

Figure 2:
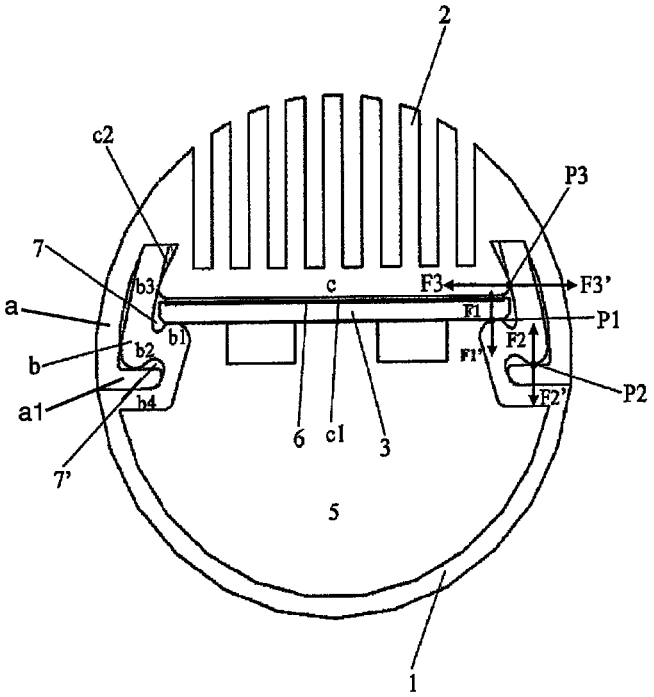
FIG. 2 is a cross-sectional view of a light-emitting device, after installation, of the first embodiment according to the present invention.
Figure 3:
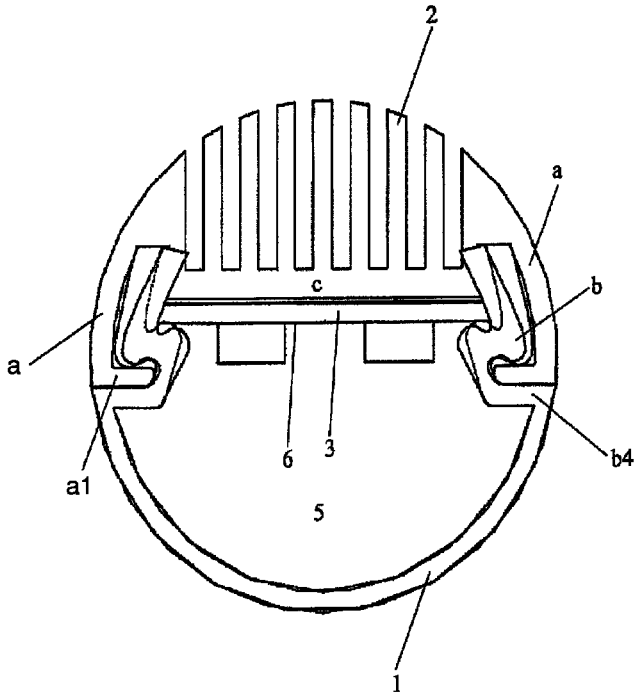
FIG. 3 is a cross-sectional view of the light-emitting device shown in FIG. 1 during installation.
Figure 4:
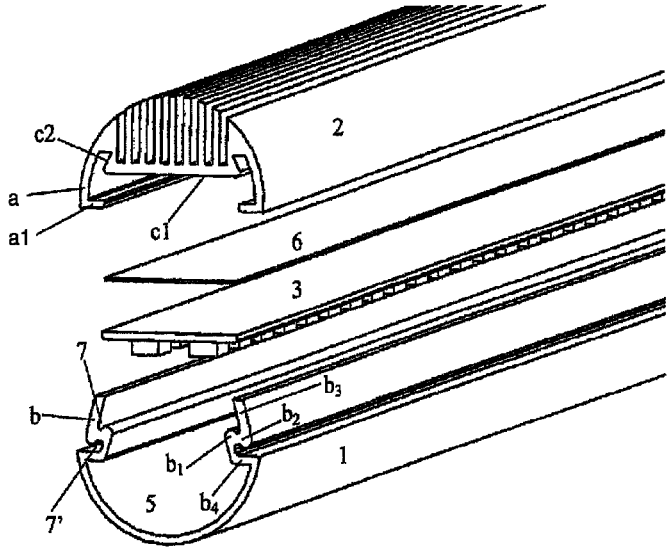
FIG. 4 is an exploded 3D view of the light-emitting device shown in FIG. 1.

Before installation, viz. when the second locking parts b of the cover 1 is not yet inserted into the first locking parts a of the heat sink 2, respectively, and the light-emitting assembly 3 and the thermal conduct pad 6 are pressed against the heat sink 2, a distance between the two second locking parts b is smaller than a distance between the two first locking parts a. Since the cover 1 is made of an elastic transparent material, e.g. transparent plastic, external forces may be applied to the two second locking parts b, for example, the applied external forces separate the two second locking parts b from each other and to allow them to be from each other until a distance between the two is equal to the distance between the two first locking parts a, so that the two second locking parts b can be inserted into the two first locking parts a, respectively. Herein, the cover 1 is caused to be deformed by virtue of the material properties of the cover 1 itself and the special configuration of the second locking parts b. In FIGS. 2 to 4, the structures of the first locking parts a and the second locking parts b and the deformation of the cover 1 will be described in detail.

FIG. 2 is a cross-sectional view of a light-emitting device, after installation, according to the present invention. In FIG. 2, the cover 1 and the heat sink 2 are inserting connected with each, by means of the second locking parts b and the first locking parts a, and form an enclosed cavity 5.

At the side of the heat sink 2, the heat sink 2 comprises a mounting part c centrally located for the light-emitting assembly 3 and the thermal conduct pad 6 and outer edges a at two sides, thereby the first locking parts a, viz. locking slots, can be defined, wherein an end of respective outer edge a is an inward-bending part a1. A bottom surface of the mounting part c is an even mounting surface c1 of the heat sink 2, and a side surface c2 of the mounting part c extends obliquely outward and connects with the mounting surface c1.

As to the cover 1, besides having counter-connecting edges b4 respectively counter connecting with the inward-bending parts a1 of the outer edges a, it also has the second locking parts b connecting with the counter-connecting edges b4, respectively. Respective second locking part b has a curved configuration similar to a longitudinal S shape. Respective second locking part b has a first recessed arc-shaped part 7 and a second recessed arc-shaped part 7' adjacent to a pressing part b1 and a supporting part b2, respectively, such that buffering areas are provided when the second locking parts b are deformed and the breakage is prevented, and assembling spaces are reserved for corresponding parts of the heat sink 2, for example, spaces are reserved for end corners of the heat sink 2. By means of such a unique shape of the second locking parts b, the light-emitting assembly 3 is advantageously fixed without a fastening member or adhesive.

In this embodiment, respective second locking part b consists of three segments b1 to b3 connected sequentially, wherein the pressing part b1 connects with the supporting part b2 and is against the light-emitting assembly 3 at a pressing point PI; the supporting part b2 connects with a clamping part b3 and is against the inward-bending part a1 of first locking part a at a supporting point P2; and the clamping part b3 is against the side surface c2 of the mounting part c at a clamping convex point P3. The counter-connecting edge b4 and the pressing part b1 as well as the supporting part b2 and the clamping part b3 constitute a recess for receiving corresponding inward-bending part a1. In order to realize the shape engagement between the cover 1 and the heat sink 2, contact surfaces of the counter-connecting edge b4 and the inward-bending part a1 abut tightly against each other.

According to the force analysis on the right of FIG. 2, it can be seen that, when the cover 1, the light-emitting assembly 3 and the thermal conduct pad 6 are inserted into the heat sink 2, since the non-rigid cover 1 itself is elastic, the second locking part b inserted into the first locking part a and the side surface c2 of the mounting part c are against the clamping convex point P3 due to the deforming property of the cover 1 made of plastic, whereby a horizontal pushing force F3' pointed to the outside of the heat sink 2 and a clamping force F3 pointed to the heat sink 2 are created, and the clamping force F3 and the horizontal pushing force F3' are counterforces to each other. Meanwhile, at the supporting point P2, the inward-bending part a1 provides an upward supporting force F2 for the supporting part b2, and the supporting part b2 provides a downward pressure FT for the inward-bending part a1, and the supporting force F2 and the pressure FT are counterforces to each other. Since the cover 1 at this time is deformed under the effect of the forces, the supporting force F2 acting on the second locking part b allows the second locking part b to be perpendicular to the mounting surface c1 of the mounting part c at the pressing point PI via a pressing force F1 and the pressure F1', such that the light-emitting assembly 3 and the thermal conduct pad 6 are pressed against the mounting surface c1.

FIG. 3 is a cross-sectional view of the light-emitting device shown in FIG. 1 during installation. From the figure, the deforming process of the cover 1 can be seen clearly. As a result, the effect that the first locking parts a and the second locking parts b abut against each other, respectively, is achieved.

FIG. 4 is an exploded 3D view of the light-emitting device shown in FIG. 1. In this embodiment, the light-emitting device is configured to have a tube shape. Such a configuration facilitates installation by inserting the cover 1 from ends of the heat sink 2 as a base into the heat sink 2.

Figure 5:
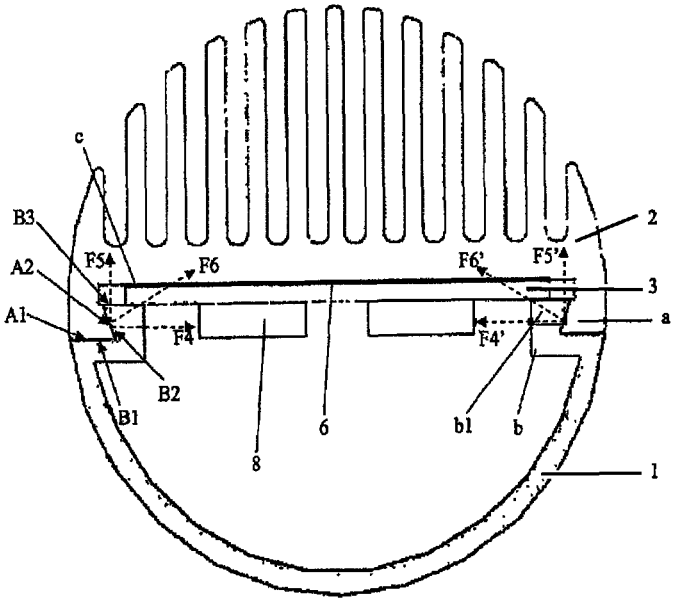
FIG. 5 is a cross-sectional view of a light-emitting device, after installation, of a second embodiment according to the present invention.

FIG. 5 is a cross-sectional view of a light-emitting device, after installation, of a second embodiment according to the present invention. In this preferred embodiment, different from the first embodiment, the first locking parts a are configured as end segments of the heat sink 2, respective end segment has a first contact surface A1 parallel to the mounting part c and a second contact surface A2 forming an angle with the first contact surface A1; correspondingly, the second locking parts b are configured as end segments of the cover 1, and respective end segment has a third contact surface B1 capable of overlapping the first contact surface A1 in a vertical direction and a fourth contact surface B2 tightly against the second contact surface A2; in addition, respective second locking part b further comprises a top surface B3 against the light-emitting assembly 3 in a vertical direction, wherein a part of the top surface B3 is a top surface of the pressing part b1 pressing the light-emitting assembly 3 against the heat sink 2. Herein, a plurality of LEDs 8 are mounted on the light-emitting assembly 3. In a preferred situation, an angle defined between the first contact surface A1 and the second contact surface A2 is less than 90°, particularly equal to 45°. The first contact surface A1 and the third contact surface B1 can contact each other in a preferred solution, but they do not necessarily contact each other.

In the present embodiment, the heat sink 2 and the cover 1 can be simply fixed together, that is to say, the cover 1 is clamped, via its two end segments, between the two end segments of the heat sink 2. As these segments are defined by flat surfaces, they are easily fabricated and installed. Via the elastic deformation of the cover 1, two clamping forces F6, F6' are generated between the first locking parts a and corresponding second locking parts b. The two clamping forces F6, F6' are located symmetrically at both sides of the light-emitting device, respectively, and can act uniformly on respective surfaces of the first and the second locking parts a, b.

It can be seen from FIG. 5 that respective first locking part a and corresponding second locking part b are tightly against each other by means of two pairs of contact surfaces, namely, A1 and B1, A2 and B2. In the horizontal direction, a horizontal component F4 of the clamping force F6 applied by the first locking a to the corresponding second locking part b on the left of FIG. 5 and a horizontal component F4' of the clamping force F6' applied by the first locking part a to the corresponding second locking part b on the right of FIG. 5 can be allowed to be in opposite directions. When the light-emitting device is configured to be symmetric with respect to a central axis of the circuit board, the horizontal component F4 on the left and the horizontal component F4' on the right are equal and in opposite directions. In the vertical direction, the two pressing parts b1 are in contact with the light-emitting assembly 3 under the effect of forces, and two points of force application are formed, a sum of the two vertical components F5 and F5' of the two clamping forces F6 and F6' is equal to a pressure applied by the cover 1 on the light-emitting assembly 3. Via this pressure, the light-emitting assembly 3 can be fixedly pressed on the mounting part c. When the light-emitting device is configured to be symmetric with respect to a central axis of the circuit board, the horizontal component F5 on the left of FIG. 5 and the horizontal component F5' on the right of FIG. 5 are equal and in opposite directions.

Figure 6:
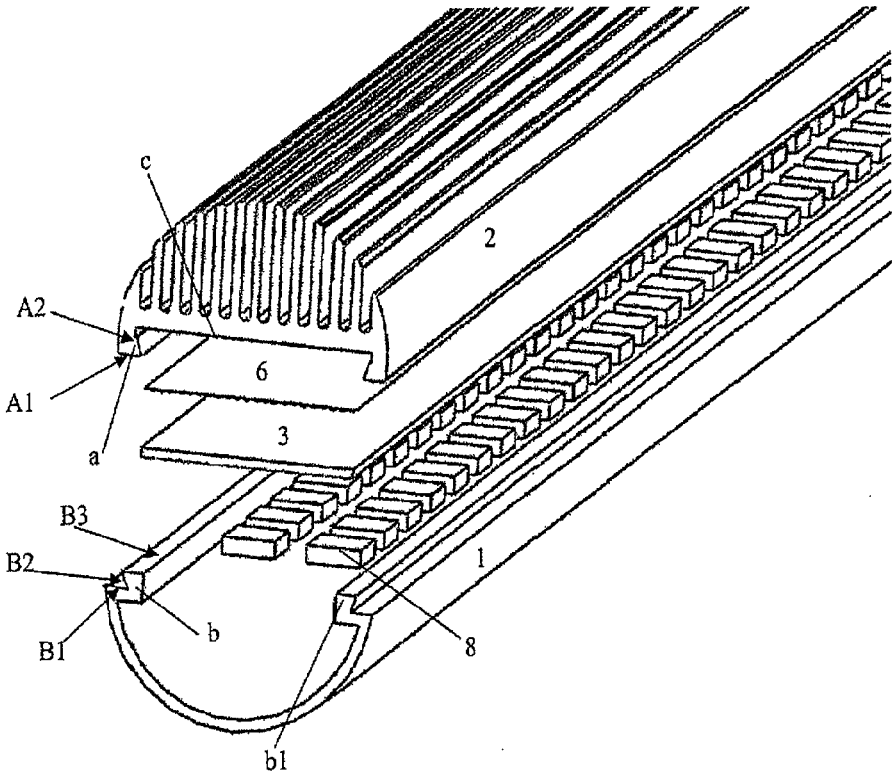
FIG. 6 is an exploded 3D view of the light-emitting device shown in FIG. 5.

FIG. 6 is an exploded 3D view of the light-emitting device shown in FIG. 5. Similar to the light-emitting device shown in FIG. 4, the light-emitting device of the second embodiment also can be simply mounted without additional fixing member. As the first and second locking parts a, b in this embodiment are both configured to be wedge-shape with an acute angle, the fabrication and installation are simplified.

The descriptions above are only preferable embodiments of the present invention and are not used to restrict the present invention. For those skilled in the art, the present invention may have various changes and variations. Any modifications, equivalent substitutions, improvements etc. within the spirit and principle of the present invention shall all be included in the scope of protection of the present invention.

The invention claimed is:

1. A light-emitting device comprising:

a heat sink having at least one first locking part, a planar mounting part, and two outer edges located proximate two sides of the mounting part, the at least one first locking part being shaped so as to form at least one locking slot between the mounting part and one of the two outer edges, the at least one locking slot having a planar inward bending part at an end of the at least one locking slot extending away from one of the outer edges of the heat sink, the inward bending part being parallel to the mounting part;

a cover formed of an elastic, optically transparent material having at least one elastically deformable second locking part along an edge of the cover; and a light-emitting assembly mounted onto the mounting part, wherein the at least one second locking part pressingly engages with the at least one first locking part to form an enclosed cavity for the light-emitting assembly so that an entirety of the at least one second locking part is on a cavity side of the at least one first locking part, wherein the at least one second locking part has a pressing part pressing the light-emitting assembly in a first direction against the mounting part of the heat sink, wherein the at least one second locking part has a supporting part pressing the at least one second locking part against a first surface of the inward bending part of the at least one first locking part in a direction opposite to the first direction, the supporting part being disposed entirely in the at least one locking slot, the at least one second locking part having a counter connecting edge contacting a second surface of the inward bending part opposite the first surface of the inward bending part, and wherein the at least one second locking part has a first recessed arc-shaped part forming the pressing part, and wherein the at least one second locking part has a second recessed arc-shaped part forming the supporting part, the first recessed arc-shaped part and the second arc-shaped part being directly connected to one another to form an S-shape in cross-section.

2. The light-emitting device according to claim 1, wherein the at least one second locking part is a bending locking segment that is received in the locking slot.

3. The light-emitting device according to claim 2, wherein the pressing part is a protruding elastic bending part of the at least one second locking part.

4. The light-emitting device according to claim 2, comprising two second locking parts on opposite sides of the mounting part, and wherein a side surface of the mounting part defining the locking slot extends obliquely outward and forms a clamping convex point together with a mounting surface of the mounting part, and each second locking part has an end thereof formed with a clamping part acting on the clamping convex point and each second locking part applies clamping force toward the other second locking part.

5. The light-emitting device according to claim 4, wherein the supporting part is between the pressing part and the clamping part to be against an inner surface of the inward-bending part.

6. The light-emitting device according to claim 1, wherein respective first locking part has a first contact surface and a second contact surface capable of interacting with corresponding second locking part, wherein an angle defined between the first contact surface and the second contact surface is less than 90°.

7. The light-emitting device according to claim 6, wherein the angle defined between the first contact surface and the second contact surface is 45°.

8. The light-emitting device according to claim 6, wherein respective second locking part comprises:

a third contact surface contacting the first contact surface, a fourth contact surface contacting the second contact surface, and a top surface contacting the light-emitting assembly.

9. The light-emitting device according claim 8, wherein a sum of vertical components of the clamping forces is equivalent to a pressure applied by the cover to the light-emitting assembly.

10. The light-emitting device according to claim 1, wherein the heat sink is made of a thermal conducting metal.

11. The light-emitting device according to claim 1, wherein a thermal conducting pad is positioned between the heat sink and the light-emitting assembly.

12. The light-emitting device according to claim 1, wherein the light-emitting assembly comprises a circuit board and a light source mounted on the circuit board.

13. The light-emitting device according to claim 1, wherein the at least one first locking part is formed of an inelastic material.

* * * * *